US005549752A

United States Patent [19]

Hahn et al.

[11] Patent Number: 5,549,752

[45] Date of Patent: Aug. 27, 1996

[54] APPARATUS FOR COATING STRIP MATERIAL

[75] Inventors: Roger Hahn; Ray Bowles; Wendel Phelps, all of Golden, Colo.

[73] Assignee: Coors Brewing Company, Golden, Colo.

[21] Appl. No.: 428,878

[22] Filed: Apr. 25, 1995

Related U.S. Application Data

[63] Continuation-in-part of Ser. No. 298,211, Aug. 29, 1994, abandoned.

[51] Int. Cl.[6] ..... B05C 1/00

[52] U.S. Cl. ..... 118/234; 118/244; 118/266; 118/268

[58] Field of Search ..... 118/234, 244, 118/264, 266, 268, 114, 126, 227; 427/209, 428, 429

[56] References Cited

U.S. PATENT DOCUMENTS

| | | | |
|---|---|---|---|
| 4,601,918 | 7/1986 | Zaman et al. | 118/234 |
| 4,604,300 | 8/1986 | Keys et al. | 118/266 |
| 4,712,507 | 12/1987 | Helling | 118/264 |
| 4,995,934 | 2/1991 | Janatka | 118/264 |

OTHER PUBLICATIONS

Brochure from Lubriquip, Centralized Lubrication Systems (1991).

*Primary Examiner*—Laura Edwards
*Attorney, Agent, or Firm*—Klaas, Law, O'Meara & Malkin, P.C.; Joseph J. Kelly

[57] ABSTRACT

Apparatus for applying a coating material, such as a lubricant, to the top and bottom surfaces of a continuous strip of material wherein the continuous strip of material is passed between two wicks mounted in each of an upper and lower housings with each of the housings having a plurality of spaced apart bores and wherein metered amounts of the coating material is supplied sequentially to each of the plurality of spaced apart bores by a piston mounted for reciprocating movement. In another embodiment, the wicks apply coating material to the outer surface of an upper drive roll and a lower idler roll so that coating material is applied to the upper and lower surfaces of a continuous strip of material as it passes therebetween.

15 Claims, 4 Drawing Sheets

APPARATUS FOR COATING STRIP MATERIAL

This application is a continuation-in-part of U.S. patent application Ser. No. 08/298,211 filed Aug. 29, 1994 for APPARATUS FOR COATING STRIP MATERIAL of Hahn et al. now abandoned.

FIELD OF THE INVENTION

This invention relates generally to apparatus for applying a lubricant to both sides of a continuous strip of material and more particularly to apparatus for applying desired amounts of lubricant to each side of the continuous strip of material.

BACKGROUND OF THE INVENTION

In the manufacture of aluminum cans it is customary to feed a continuous strip of aluminum to a punch press which forms shallow cup shaped blanks from a strip. The shallow cup shaped blanks are then used in a body maker machine which pushes the shallow cup shaped blanks through can forming and ironing dies to elongate and shape the shallow cup shaped blanks into can bodies. The foregoing operations require substantial contacting relationships between apparatus and the aluminum material. Therefore, it is necessary to apply a lubricating material to each side of the continuous strip of aluminum prior to feeding it into the punch press. One conventional method of applying such lubricating material to the continuous strip of aluminum is to pull the continuous strip of aluminum through a bath of lubricating material and squeeze off any excess lubricating material.

BRIEF DESCRIPTION OF THE INVENTION

This invention provides apparatus for applying a coating material, such as a lubricating material, to each surface of a continuous strip of aluminum wherein the strip of aluminum passes between a first and a second coating wick wherein the first coating wick coats one surface of the strip of material with an evenly distributed precise amount of the lubricating material and the second coating wick coats the other surface of the strip of aluminum with an evenly distributed precise amount of lubricating material and wherein the amount of lubricating material on the one surface may differ from the amount of lubricating material on the other surface. Also, the kind of lubricating material on the one surface can differ from that on the other surface.

In a preferred embodiment of the invention, the apparatus for applying a coating material on both sides of a continuous strip of material comprises a coating station and feed means for feeding a continuous strip of material to the coating station. The coating station has an upper coating applicator and a lower coating applicator. Each of the upper and lower coating applicators comprises a housing having a recess formed therein so that the recesses are in a facing relationship. A wick is located in each of the recesses. Each of the housings has a plurality of spaced apart bores formed therein and each bore is in fluid communication with a portion of the wick. Supply means are provided for supplying a coating material to the plurality of bores for passage therethrough to be absorbed by the wick. The upper wick is located to contact the upper surface of the continuous strip of material and to apply the coating material thereto as the continuous strip of material passes between the wicks and the lower wick is located to contact the lower surface of the continuous strip of material and to apply the coating material thereto as the continuous strip of material passes between the wicks.

Metering means are provided for metering the amount of the coating material supplied to each of the plurality of bores. The metering means comprise a hollow piston mounted for reciprocating movement in each of the housings. Connecting means are provided for connecting the hollow piston to the supply means so that the hollow piston may be filled with the coating material. The hollow piston has a plurality of spaced apart passageways formed therein so that the coating material moves through the spaced apart passageways and into the plurality of spaced apart bores. The hollow piston is connected to the supply means so that during a forward stroke thereof the coating material is forced through the plurality of spaced apart passageways and into the spaced apart bores and during a return stroke, coating material is withdrawn from the supply means of the coating material. A plurality of spaced apart grooves are formed in the outer surface of the hollow piston and are in fluid communication with the passageways. The plurality of spaced apart grooves are located relative to the plurality of spaced apart bores so that, during the forward stroke of the hollow piston, each of the plurality of spaced apart grooves moves into fluid communication with one of the plurality of spaced apart bores but only one of the plurality of spaced apart grooves is in fluid communication with one of the plurality of spaced apart bores at any portion of the forward stroke of the hollow piston.

Support means are provided and each housing is pivotally mounted on the support means so that the housings can be moved between an opened position and a closed position. Each of the recesses in the housings has an entrance portion having a width that is less than the width of the wick so that the wick is frictionally retained in the recess.

The connecting means comprise a chamber between the supply means and the hollow piston; a one way valve between the supply means and the chamber for permitting movement of the coating material from the supply means into the chamber but preventing movement of the coating material from the chamber and into the supply means; and another one way valve between the hollow piston and the chamber for permitting movement of the coating material from the chamber and into the hollow piston but preventing movement of the coating material from the hollow piston and into the chamber.

Another preferred embodiment of the invention has upper and lower housings having wicks and a plurality of spaced apart bores in fluid communication with the wick. A pump is mounted on a mounting plate on each of the upper and lower housings. The pump has a piston that has a central passageway having a one way valve for permitting the coating material to move into the central passageway when moving in one direction but preventing movement of coating material out of the central passageway when moving in the opposite direction. The central passageway has a radial passageway formed therein that is in fluid communication with an annular groove formed in the outer surface of the piston. The pump has a plurality of fitting receiving openings that are in a spaced apart relationship in the direction of movement of the piston. Fittings are provided in the bores and in the fitting receiving opening and tubes extend between these fittings. As the piston moves in the one direction, coating material moves through the radial passageway into the annular groove and sequentially into each of the plurality of spaced apart fitting receiving bores. In this embodiment, the upper housing is mounted for reciprocating movement toward and away from the lower housing.

In another preferred embodiment of the invention, an upper wick is located to apply coating material to an upper drive roll and a lower wick is located to apply coating material to a lower idler roll so that, when the continuous strip of material, such as aluminum, passes between the upper drive roll and the lower idler roll, coating material is applied to the upper and lower surfaces of the continuous strip of aluminum.

BRIEF DESCRIPTION OF THE DRAWING

Illustrative and presently preferred embodiments of the invention are illustrated in the drawings which.

DETAILED DESCRIPTION OF THE INVENTION

Figure 1:
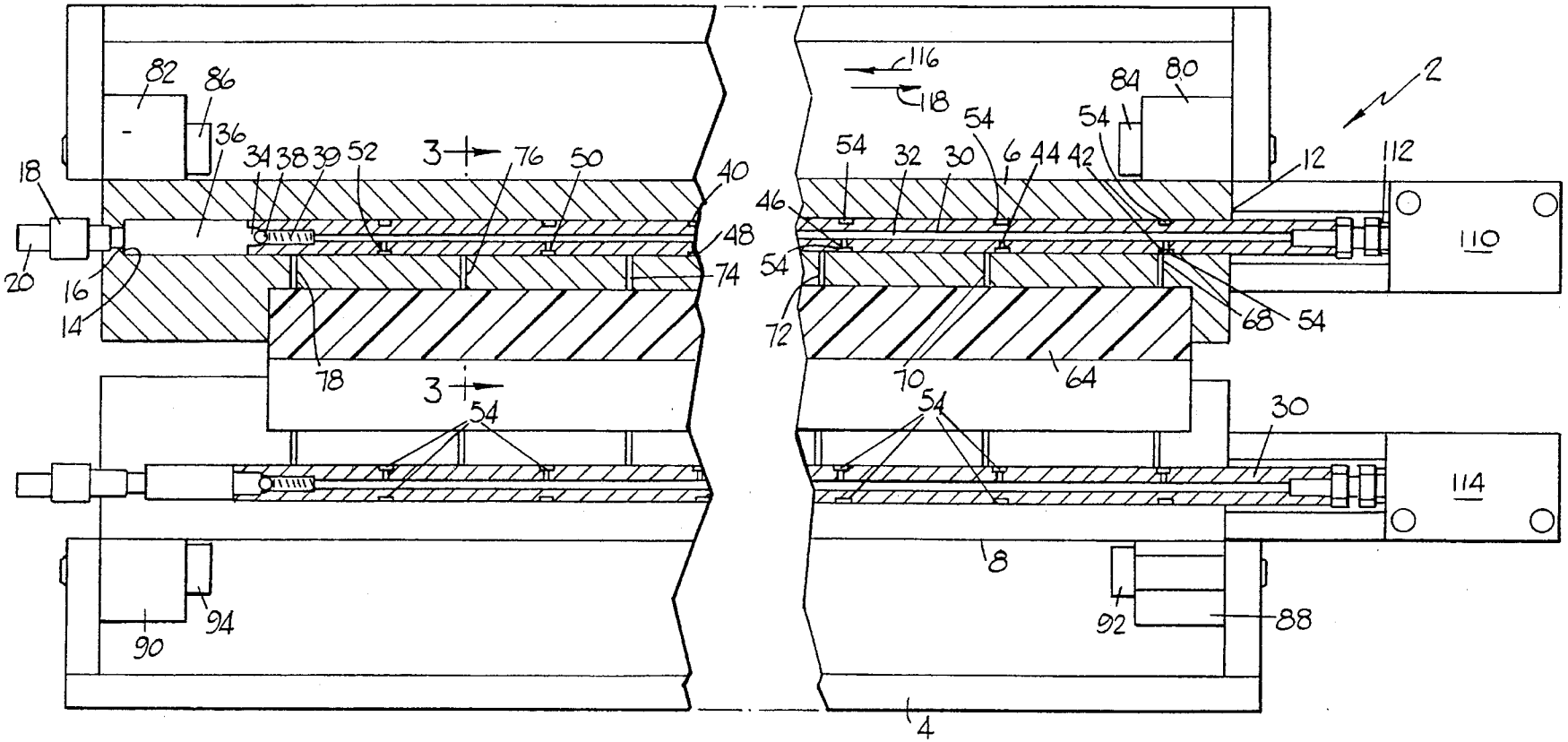
FIG. 1 is a front elevational view of one preferred embodiment of the invention with parts in section.

In FIG. 1, there is illustrated one preferred embodiment of apparatus 2 for applying a coating material, such as a lubricating material, to both sides of a continuous strip of material. A support frame 4 is mounted at a desired location by suitable support means (not shown). An upper housing 6 and a lower housing 8 are mounted on the support frame 4. Since the upper and lower housings 6 and 8 are identical, the description will be made in relation to the upper housing 6.

The upper housing 6 has a longitudinally extending bore 10 formed therein having an opening 12 at one end of the upper housing 6 and an open end wall 14. Another longitudinally extending bore 16 is formed in the upper housing 6 and is of smaller diameter than the longitudinally extending bore 10 so as to form the end wall 14. A one way valve 18 is fitted into the longitudinally extending bore 16 and has one end 20 connected to a supply of coating material. Resilient means (not shown) normally hold the one way valve 18 in a closed position.

A hollow piston 30 is mounted for sliding movement in the longitudinally extending bore 10 and has a central passageway 32 formed therein. The end portion 34 of the hollow piston 30 is spaced from the end wall 14 so as to form a chamber 36 for holding a quantity of the coating material. A one way valve 38 is located in the hollow piston 30 and functions to permit the coating material to move from the chamber 36 into the central passageway 32 but to prevent the coating material from moving from the central passageway 32 into the chamber 36. Resilient means 39 normally hold the one way valve 38 in a closed position. The one way valve 18 functions to permit the coating material to move from the supply of coating material into the chamber 36 but to prevent the coating material from moving from the chamber 36 into the supply of coating material. The hollow piston 30 preferably has a cylindrical outer surface 40. A plurality of radially extending branch passageways 42, 44, 46, 48, 50 and 52 are in fluid communication with the central passageway 32 and one of the plurality of spaced apart, circumferential grooves 54 formed in the outer surface 40.

Figure 3:
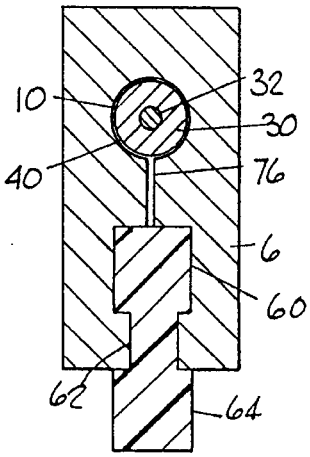
FIG. 3 is an enlarged cross-sectional view taken on the line 3—3 of FIG. 1.
Figure 5:
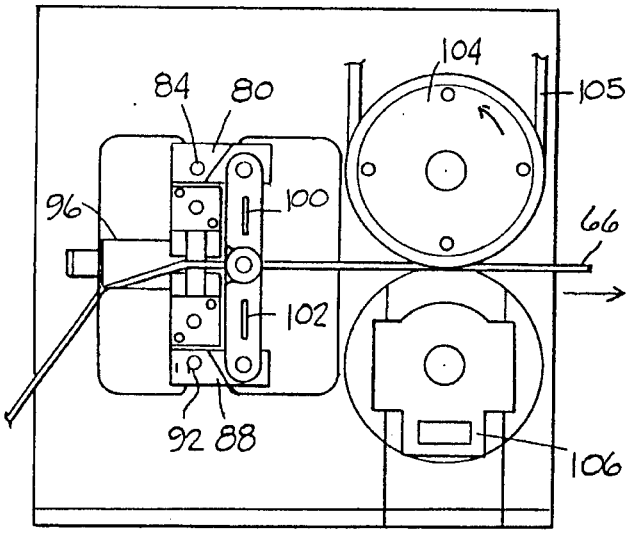
FIG. 5 is a side elevational view with parts removed and illustrating the coating apparatus in a closed position.
Figure 6:
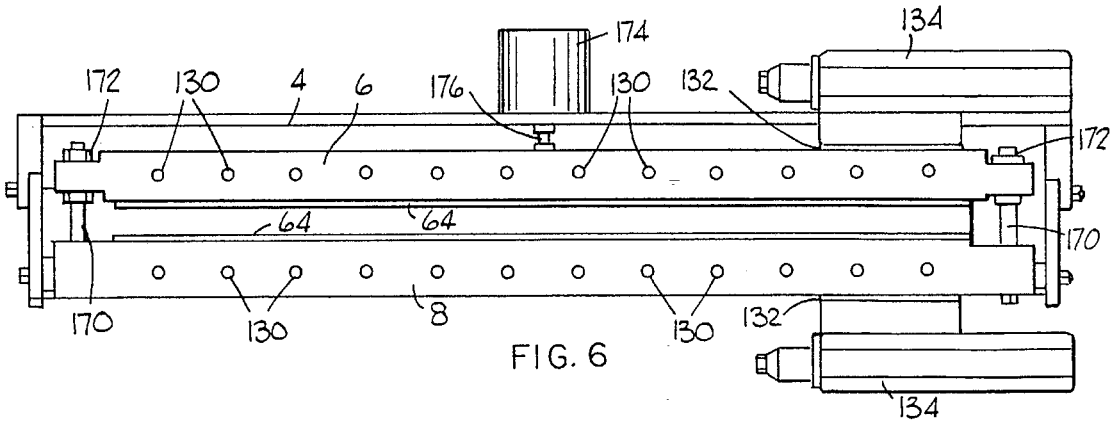
FIG. 6 is a front elevational view of another embodiment with parts removed.

A longitudinally extending recess 60 is formed in the upper housing 6 and has a relatively narrow entrance portion 62. A wick 64 is secured in the recess 60 and projects outwardly therefrom so that it can contact a surface of the continuous strip of material 66, FIG. 5. The wick 64 is formed from a material, such as polyurethane foam, or other materials having similar characteristics. As illustrated in FIG. 3, the width of the wick 64 is greater than the width of the entrance portion 62 so as to retain the wick 64 in the recess 60. A plurality of spaced apart bores 68, 70, 72, 74, 76 and 78 are formed in the upper housing 6 and are in fluid communication with the longitudinally extending bore 10 and the wick 64.

Figure 4:
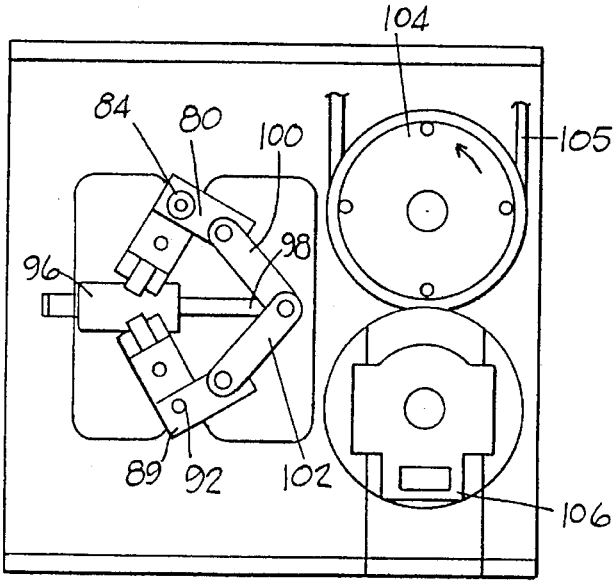
FIG. 4 is a side elevational view of FIG. 1 with parts removed and illustrating the coating apparatus in an opened position.

The upper and lower housings 6 and 8 are pivotally mounted on the support frame 4. Arms 80 and 82 are secured to the upper housing 6 and are pivotally mounted on pivot pins 84 and 86 secured on the support frame 4. Arms 88 and 90 are secured to the lower housing 8 and are pivotally mounted on pivot pins 92 and 94 secured to the support frame 4. An air cylinder 96 is mounted on the support frame 4 and moves a piston rod 98. A toggle arm 100 is pivotally mounted on the arm 80 and the piston rod 98 and a toggle arm 102 is pivotally mounted on the arm 88 and the piston rod 98. The movement of the piston rod 98 pivots the arms 80, 82, 88 and 90 around the pivot pins 84, 86, 92 and 94 to move the upper and lower housings 6 and 8 between an opened position, FIG. 4, and a closed position, FIG. 5. When in the opened position, the continuous strip 66 of material can be fed into the apparatus 2 or the wicks 64 can be replaced. The continuous strip 66 of material passes between two spaced apart drive rolls 104 driven by a drive belt 105 and two spaced apart idler rolls 106 which function in a conventional manner to pull the continuous strip 66 of material between the wicks 64.

An air cylinder 110 is mounted on the support frame 4 and has a piston rod 112 connected to the end of the hollow piston 30 and functions to close the central passageway 32 and to reciprocate the hollow piston 30. A similar air cylinder 114 reciprocates a hollow piston 30 in the lower housing 8.

Figure 2:
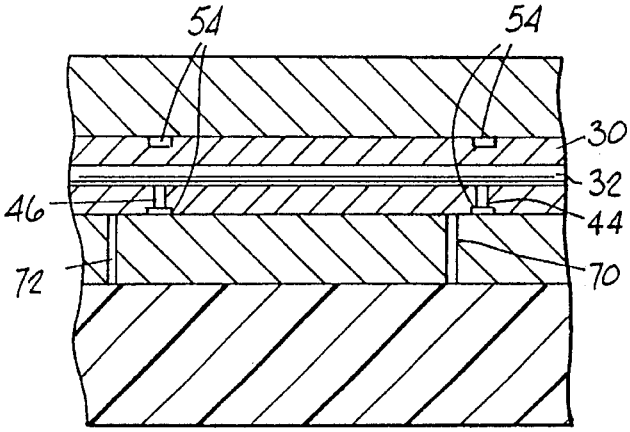
FIG. 2 is an enlarged portion of FIG. 1.

In operation, the hollow piston 30 is reciprocated until the wicks 64 are loaded with the desired amount of coating material and the bores 68, 70, 72, 74, 76 and 78; the plurality of grooves 54; the radial passageways 42, 44, 46, 48, 50 and 52; the central passageway 32 and the chamber 36 are filled with coating material. The normal operation is then commenced with the hollow piston 30 in the position illustrated in FIG. 1. The air cylinder 110 moves the hollow piston 30 in the direction indicated by the arrow 116. This movement opens one way valve 38 to permit coating material to move from the chamber 36 into the central passageway 32 and closes one way valve 18 to prevent movement of coating material out of the chamber 36 into the supply 20 of coating material. As illustrated in FIGS. 1 and 2, the radially passageways 42, 44, 46, 48, 50 and 52 are located relative to the bores 68, 70, 72, 74, 76 and 78 so that the grooves 54 thereof will be moved sequentially into fluid communication with the bores 68, 70, 72, 74, 76 and 78. This is illustrated particularly in FIG. 2. The distance between the groove 54 of the radial passageway 44 and the bore 70 is less than the distance between the groove 54 of the radial passageway 46 and the bore 72. Therefore, when the groove 54 of radial passageway 44 is in fluid communication with the bore 70 to permit the movement of coating material into the bore 70, the groove 54 of the radial passageway 46 will not be in fluid communication with the bore 72. Also, when the groove 54 of the radial passageway 46 moves into fluid communication with the bore 72 to permit the movement of coating material into the bore 72, the groove 54 of the radial passageway 44 will not be in fluid communication with the bore 70. Because of the use of the grooves 54, it is not necessary that the radial passageways 42, 44, 46, 48, 50 and 52 be in alignment with the bores 68, 70, 72, 74, 76 and 78. The movement of the hollow piston 30 in the direction of the arrow 116 is continued until the groove 54 of the radial passageway 52 moves past the bore 78. The movement of the hollow piston 30 in the direction of the arrow 116 applies pressure to the coating material in the chamber 36 to open the one way valve 38 and force coating material through the central passageway 32; the radial passageways 42, 44, 46, 48, 50 and 52; the grooves 54; the bores 68, 70, 72, 74, 76 and 78 into the wick 64. When the movement of the hollow piston 30 in the direction of the arrow 116 is stopped, the one way valve 38 returns to its normally closed position so that coating material cannot move out of the central passageway 32. The air cylinder now moves the hollow piston 30 in the direction indicated by the arrow 118. This causes a vacuum to be formed in the chamber 36 to open one way valve 18 and draw coating material into the chamber 36. The movement of the hollow piston 30 in the direction of the arrow 118 is continued until the groove 54 of the radial passageway 42 has moved past bore 68 as illustrated in FIG. 1. The apparatus in the lower housing 8 operates in the same way.

The distance between the center lines of adjacent bores 68, 70, 72, 74, 76 and 78 is at least equal to the width of the groove 54 plus the diameter of the bore. In one example, the groove 54 has a width of 0.102 inch. The required movement of the hollow piston 30 to supply coating material to the wick 64 depends upon the number of radial passageways 42, 44, 46, 48, 50 and 52 and the number of bores 68, 70, 72, 74, 76 and 78. In one example for coating a 36 inch wide continuous strip of aluminum, there would be twelve radial passageways and twelve bores. The hollow piston 30 would be moved slightly less than 1.50 inches to move coating material through each of the bores.

In a preferred embodiment of the invention, the coating material is a lubricant, such as neat oil or other similar materials. The continuous strip of material is aluminum. The amount of lubricant applied to the wicks is controlled by the diameter of the hollow piston, the central passageway, the radial passageways, and the bores; the width of the grooves and the rate of reciprocation. Therefore, the upper housing 6 may apply move or less lubricant to the top surface of the continuous strip of aluminum than the lower housing 8 applies to the bottom surface of the continuous strip of aluminum. In one operation, the preferred amount of lubricant on the top surface of the continuous strip of aluminum is about 30.0 milligrams per square foot and the preferred amount on the bottom surface is about 90.0 milligrams per square foot. Also, different types of lubricants can be applied to the top and bottom surfaces.

Another preferred embodiment of the invention is illustrated in FIGS. 6–11 wherein corresponding parts have been identified with the same reference numerals. This embodiment has upper and lower housings 6 and 8 with a wick 64 mounted in each of the upper and lower housings 6 and 8. A plurality of spaced apart bores 130 are formed in the housings 6 and 8 and each bore 130 is in fluid communication with the wick 64. Each of the upper and lower housings 6 and 8 has a mounting plate 132 and a pump 134 is mounted on each mounting plate 132. The pump is of the type marketed by Lubriquip Inc. under the trade designation Trabon.

Figure 7:
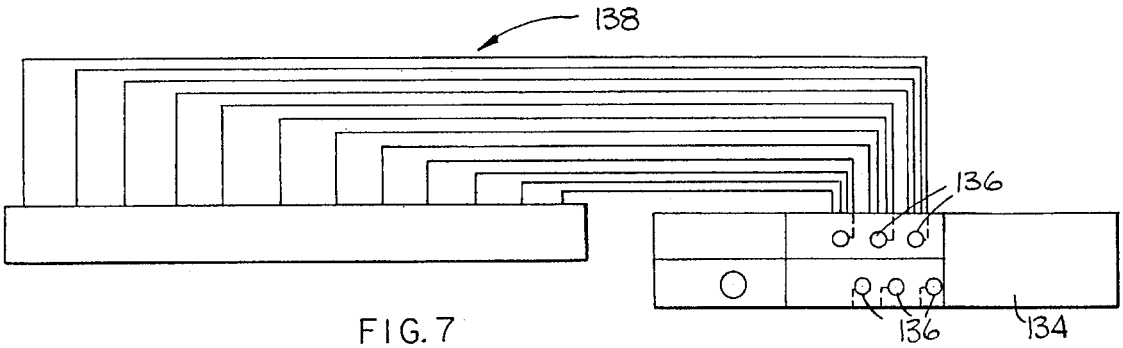
FIG. 7 is a schematic illustration of the manifold system for this embodiment.
Figure 9:
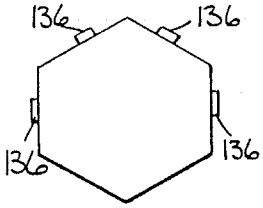
FIG. 9 is an end elevational view of a portion of FIG. 8.
Figure 10:
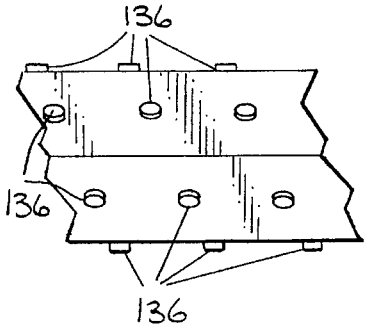
FIG. 10 is a top plan view of a portion of FIG. 8.

The manifold system is schematically illustrated in FIGS. 7, 9 and 10. The pump 134 has a hexagonal cross-sectional configuration and a plurality of fittings 136 are mounted in staggered relationship on four sides thereof. Tubing 138 extends between one of the fittings 136 and one of the bores 130.

Figure 8:
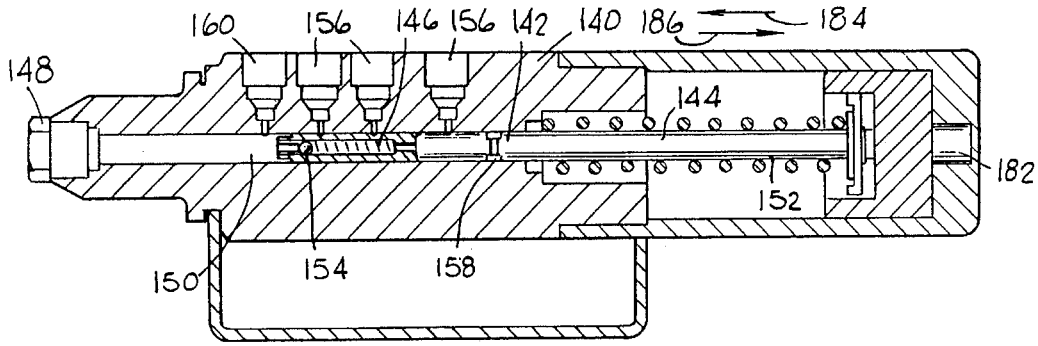
FIG. 8 is a cross-sectional view of a pump.

The pump 134 is illustrated in FIG. 8. The pump 134 has a housing 140 having a longitudinally extending bore 142 formed therein. A piston 144 is mounted for sliding movement in the longitudinally extending bore 142 and has a central passageway 146 formed in a portion thereof. A plug 148 is used to the end of the longitudinally extending bore 142 to form a chamber 150. A spring 152 is located around a portion of the piston 144. A one way valve 154 is mounted at the end of the central passageway 146 and functions to permit coating material to move from the chamber 150 into the central passageway 146 but to prevent coating material from moving from the central passageway 146 into the chamber 150. A plurality of fitting receiving openings 156 for receiving the fittings 136 are formed in the housing 140 and are in fluid communication with the central passageway 146. The fitting receiving openings 156 are located in the same manner as the fittings 136. An annular groove 158 is formed in the outer surface of the piston 144 radially opposite to the end portion of the central passageway 146. A radial passageway (not shown), similar to each of the radial passageways 42, 44, 46, 48 and 50, is in fluid communication with the central passageway 146 and the annular groove 158. A fitting 160 is connected to a source of coating material under pressure and feeds coating material into the chamber 150 as described below.

The upper housing 6 is mounted for reciprocating movement toward or away from the lower housing 8 which is mounted at a fixed location. Two spaced apart posts 170 are mounted on the lower housing 8. Two bearings 172 are mounted on the upper housing 6 for sliding movement over the posts 170. An air cylinder 174 is mounted on the support frame 4 and has a piston rod 176 that reciprocates into or out of the air cylinder 174. The piston rod 176 is connected to the upper housing 6 so that the upper housing 6 moves with the piston rod 176.

Figure 11:
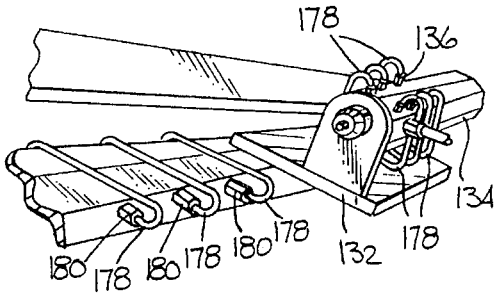
FIG. 11 is a perspective view of a portion of FIG. 6.

As illustrated in FIG. 11, a plurality of tubes 178 are connected to the fittings 136 and fittings 180 connected to the bores 130 to carry coating material from the pumps 134 to the bores 130.

In operation, the pistons 144 are reciprocated until the wicks 64 are loaded with the desired amount of coating material and the tubes 178, the bores 130 and the annular groove 158 are filled with coating material. A portion of a continuous strip of material (not shown) is threaded between the upper and lower housings 6 and 8 and the upper housing 6 is moved until the wicks 64 of the upper and lower housings are in contact with the top and bottom surfaces of the continuous strip of material. The normal operation is then commenced with the piston 144 in the position illustrated in FIG. 8. Air under pressure is introduced through the fitting 182 to move the piston 144 in the direction indicated by the arrow 184. This movement opens one way valve 154 to permit coating material to move from the chamber 150 into the central passageway 146. As the piston 144 the annular groove 158 successively moves into fluid communication with one of the fitting receiving openings 156 so that coating material moves sequentially through the tubes 178 into the bores 130. During this movement the spring 152 is compressed. When the annular groove 158 passes the last fitting receiving opening 130, the supply of pressurized air is stopped. The spring 152 then moves the piston in the direction of the arrow 186. This movement closes one way valve 154 and creates a vacuum in chamber 150 so that coating material will move through fitting 160 into the chamber 150. As stated above, the coating material is a lubricant, such as neat oil, and the continuous strip of material is aluminum.

Figure 12:
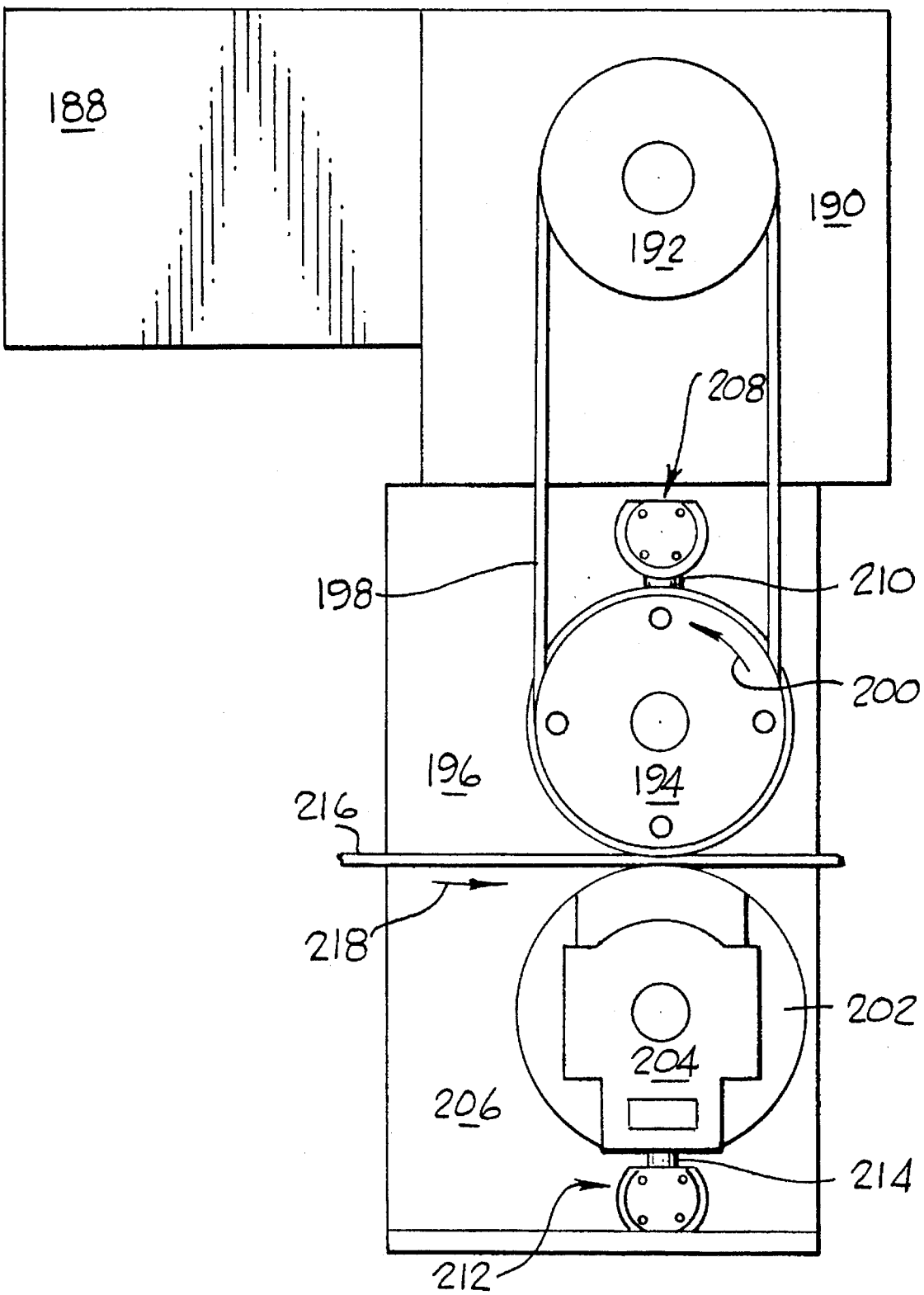
FIG. 12 is a schematic side elevational view of another preferred embodiment of the invention.

Another preferred embodiment of the invention is illustrated in FIG. 12. A motor and a gear box 188 are mounted in a support frame 190 and rotate a drive roll 192 also amounted in the support frame 190. An upper drive roll 194 is rotatably mounted in a support frame 196 and is driven by a belt 198 in a direction indicated by the arrow 200. A lower idler roll 202 is mounted for rotation in bearing blocks 204 mounted in a support frame 206.

Upper coating apparatus 208, similar to that described above, is mounted in the support frame 196 and is located so that the wick 210 thereof is in contact with the outer surface of the upper drive roll 194 so as to apply coating material thereto. Lower coating apparatus 212, similar to that described above, is mounted in the support frame 206 and is located so that the wick 214 thereof is in contact with the outer surface of the lower idler roll 202 so as to apply coating material thereto. A continuous strip of material 216, such as aluminum, moves between the upper drive roll 194 and the lower idler roll 202 in the direction indicated by the arrow 218 and as the continuous strip of material 216 passes between the upper drive roll 194 and the lower idler roll 202, coating material is applied to both the upper and lower surfaces thereof. The upper drive roll 194 and the lower idler roll 202 each have a longitudinal extent greater than the width of the continuous strip of material 216.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. Apparatus for applying a coating material on both sides of a continuous strip of material comprising:

a coating station;

drive means for pulling a continuous strip of material through said coating station;

a stationary frame;

said continuous strip of material having an upper surface and a lower surface;

said coating station having an upper coating applicator and a lower coating applicator;

each of said upper and lower coating applicators comprising a housing having a recess formed therein so that said recesses are in a facing relationship;

mounting means for mounting each of said housings on said stationary frame;

a wick located in each of said recesses;

each of said housings having a plurality of spaced apart bores formed therein and each bore being in fluid communication with a portion of said wick;

supply means for supplying a coating material to said plurality of bores for passage therethrough to be absorbed by said wick;

said upper wick being located to contact said upper surface of said continuous strip of material and to apply said coating material thereto as said continuous strip of material passes between said wicks;

said lower wick being located to contact said lower surface of said continuous strip of material and to apply said coating material thereto as said continuous strip of material passes between said wicks;

each of said housings having a longitudinally extending bore formed therein;

a hollow piston mounted for reciprocating movement in each of said longitudinally extending bores;

reciprocating means for reciprocating said piston;

connecting means for connecting said hollow piston to said supply means so that said hollow piston may be filled with said coating material; and said hollow piston having a plurality of spaced apart passageways formed therein so that said coating material moves through said spaced apart passageways and into said plurality of spaced apart bores.

2. Apparatus as in claim 1 and further comprising:

said connecting means connecting said hollow piston to said supply means so that during a forward stroke thereof said coating material is forced through said plurality of spaced apart passageways and into said spaced apart bores and during a return stroke said coating material is moved into said hollow piston.

3. Apparatus as in claim 1 wherein:

said plurality of spaced apart passageways being located relative to said plurality of spaced apart bores so that, during said forward stroke of said hollow piston, each of said plurality of spaced apart passageways moves into fluid communication with one of said plurality of spaced apart bores but only one of said plurality of spaced apart passageways is in fluid communication with one of said plurality of spaced apart bores at any portion of said forward stroke of said hollow piston.

4. Apparatus as in claim 3 and further comprising:

said connecting means connecting said hollow piston to said supply means so that during a forward stroke thereof said coating material is forced through said plurality of spaced apart passageways and into said spaced apart bores and during a return stroke said coating material is moved into said hollow piston.

5. Apparatus as in claim 4 wherein said connecting means comprise:

a chamber between said supply means and said hollow piston;

a one way valve between said supply means and said chamber for permitting movement of said coating material from said supply means into said chamber but preventing movement of said coating material from said chamber and into said supply means; and another one way valve between said chamber and said hollow piston for permitting movement of said coating material from said chamber and into said hollow piston but preventing movement of said coating material from said hollow piston and into said chamber.

6. Apparatus as in claim 1 and further comprising:

said hollow piston having a cylindrical outer surface;

said cylindrical outer surface having a plurality of spaced apart grooves formed therein and located so that each of said plurality of spaced apart grooves is in fluid communication with one of said plurality of spaced apart passageways.

7. Apparatus as in claim 6 and further comprising:

said connecting means connecting said hollow piston to said supply means so that during a forward stroke thereof said coating material is forced through said plurality of spaced apart passageways and into said spaced apart bores and during a return stroke said coating material is moved into said hollow piston.

8. Apparatus as in claim 7 wherein:

said plurality of spaced apart passageways being located relative to said plurality of spaced apart bores so that, during said forward stroke of said hollow piston, each of said plurality of spaced apart passageway moves into fluid communication with one of said plurality of spaced apart bores but only one of said plurality of spaced apart passageways is in fluid communication with one of said plurality of spaced apart bores at any portion of said forward stroke of said hollow piston.

9. Apparatus as in claim 8 wherein said connecting means comprise:

a chamber between said supply means and said hollow piston;

a one way valve between said supply means and said chamber for permitting movement of said coating material from said supply means into said chamber but preventing movement of said coating material from said chamber and into said supply means; and another one way valve between said chamber and said hollow piston for permitting movement of said coating material from said chamber and into said hollow piston but preventing movement of said coating material from said hollow piston and into said chamber.

10. Apparatus as in claim 1 wherein said mounting means comprise:

a plurality of spaced apart supports mounted on said stationary frame at fixed locations; and pivot means mounted on said plurality of spaced apart supports for pivotally mounting each of said housings on said plurality of spaced apart supports so that said housings can be moved between opened and closed positions.

11. Apparatus as in claim 1 wherein:

each of said recesses has an entrance portion having a width that is less than a thickness of said wick so that said wick is frictionally retained in said recess.

12. Apparatus for applying a coating material on both sides of a continuous strip of material comprising:

a coating station;

feed means for feeding a continuous strip of material to said coating station;

said coating station having an upper coating applicator and a lower coating applicator;

each of said upper and lower coating applicators comprising a housing having a recess formed therein so that said recesses are in a facing relationship;

a wick located in each of said recesses;

each of said housings having a plurality of spaced apart bores formed therein and each bore being in fluid communication with a portion of said wick;

supply means for supplying a coating material to said plurality of bores for passage therethrough to be absorbed by said wick;

said upper wick being located to contact the upper surface of said continuous strip of material and to apply said coating material thereto as said continuous strip of material passes between said wicks;

said lower wick being located to contact the lower surface of said continuous strip of material and to apply said coating material thereto as said continuous strip of material passes between said wicks;

a mounting plate extending outwardly from each of said housings;

a pump mounted on each of said mounting plates;

said pump connected to a source of said coating material;

said pump supplying coating materials to said bores;

wherein said pump comprises:

a housing having a longitudinally extending bore therein;

a hollow piston mounted for reciprocating movement in said longitudinally extending bore;

reciprocating means for reciprocating said piston;

said piston having a central passageway formed in a portion thereof;

connecting means for connecting said central passageway to said supply means so that said central passageway may be filled with said coating material; and said portion having a radial passageway formed therein in fluid communication with said longitudinally extending bore so that said coating material moves through said radial passageway and sequentially into each of said bores.

13. Apparatus as in claim 12 and further comprising:

mounting means for mounting said upper housing for reciprocating movement toward and away from said lower housing.

14. Apparatus as in claim 12 wherein said mounting means comprises:

a fixed support;

an air cylinder mounted on said fixed support;

said air cylinder having a piston mounted therein for reciprocating movement;

a piston rod connected to said piston and said housing; and guide means for guiding the movement of said upper housing.

15. Apparatus for applying a coating material on both sides of a continuous strip of material comprising:

a coating station;

drive means for pulling a continuous strip of material through said coating station;

a stationary frame;

said continuous strip of material having an upper surface and a lower surface;

said coating station having an upper coating applicator and a lower coating applicator;

each of said upper and lower coating applicators comprising a housing having a recess formed therein so that said recesses are in a facing relationship;

mounting means for mounting each of said housings on said stationary frame;

a wick located in each of said recesses;

each of said housings having a plurality of spaced apart bores formed therein and each bore being in fluid communication with a portion of said wick;

supply means for supplying a coating material to said plurality of bores for passage therethrough to be absorbed by said wick;

an upper drive roll having an outer surface;

a lower idler roll having an outer surface;

said upper wick being located to contact said outer surface of said upper drive roll and to apply said coating material thereto;

said lower wick being located to contact said outer surface of said idler roll and to apply said coating material thereto;

said outer surfaces of said upper drive roll and lower idler roll applying coating material to said upper and lower surfaces of said continuous strip of material;

each of said housings having a longitudinally extending bore formed therein;

a hollow piston mounted for reciprocating movement in each of said longitudinally extending bores;

reciprocating means mounted on said stationary frame and connected to said piston for reciprocating said piston;

connecting means for connecting said hollow piston to said supply means so that said hollow piston may be filled with said coating material;

said hollow piston having a plurality of spaced apart passageways formed therein so that said coating material moves through said spaced apart passageways and into said plurality of spaced apart bores;

said connecting means connecting said hollow piston to said supply means so that during a forward stroke thereof said coating material is forced through said plurality of spaced apart passageways and into said spaced apart bores and during a return stroke said coating material is moved into said hollow piston; and said plurality of spaced apart passageways being located relative to said plurality of spaced apart bores so that, during said forward stroke of said hollow piston, each of said plurality of spaced apart passageways moves into fluid communication with one of said plurality of spaced apart bores but only one of said spaced apart passageways is in fluid communication with one of said plurality of spaced apart bores at any portion of said forward stroke of said hollow piston.

* * * * *